US006904852B2

(12) United States Patent
Kaneda

(10) Patent No.: US 6,904,852 B2
(45) Date of Patent: Jun. 14, 2005

(54) SEWING MACHINE WITH NEEDLE HOLDER OF NEEDLE INTERVAL ADJUSTABLE TYPE

(75) Inventor: Tatsuaki Kaneda, Osaka (JP)

(73) Assignee: Pegasus Sewing Machine Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/753,464

(22) Filed: Jan. 9, 2004

(65) Prior Publication Data

US 2004/0221781 A1 Nov. 11, 2004

(30) Foreign Application Priority Data

Jan. 10, 2003 (JP) ..... 2003-003872

(51) Int. Cl.[7] ..... D05B 55/02
(52) U.S. Cl. ..... 112/226
(58) Field of Search ..... 112/222, 227, 112/234, 181, 199, 200, 235, 240, 323

(56) References Cited

U.S. PATENT DOCUMENTS 437,944 A * 10/1890 Stein ..... 112/226
498,212 A * 5/1893 Laskey ..... 112/226
1,515,301 A * 11/1924 Fink ..... 112/202
3,763,806 A * 10/1973 Shuffield ..... 112/226
4,993,336 A * 2/1991 Mizunuma ..... 112/226

FOREIGN PATENT DOCUMENTS

JP 3-103085 10/1991

* cited by examiner

*Primary Examiner*—Ismael Izaguirre
(74) *Attorney, Agent, or Firm*—Bacon & Thomas

(57) ABSTRACT

A main needle holder is disposed above a needle plate, and has a screw portion for fitting a needle bar. A sub needle holder is fitted to the main needle holder by a set screw so as to be adjustable in position. Fitting position of the sub needle holder to the main needle holder is changed when loosening the screw, so that the interval of the plural needle is widened or narrowed in the longitudinal direction. Plural needles are individually fitted to the needle holders, and penetrate through a needle hole of the needle plate when descending. The fitting position of the sub needle holder to the main needle holder is changed by a longitudinal slit formed linearly on the main needle holder, and the cloth penetration lines by at least two needles of plural needles can be mutually set along in a narrow width.

13 Claims, 2 Drawing Sheets

SEWING MACHINE WITH NEEDLE HOLDER OF NEEDLE INTERVAL ADJUSTABLE TYPE

BACKGROUND OF THE INVENTION

1. Field of the Invention

The present invention relates to a sewing machine with needle holder of needle interval adjustable type capable of varying the interval of plural needles by a needle holder.

2. Description of the Prior Art

A conventional sewing machine with needle holder of needle interval adjustable type was designed to adjust the interval of plural needles by rotating a sub needle holder (assistant needle holder) relatively to a main needle holder (needle holder main body) when loosening a set screw. See, for example, Japanese Utility Model Laid-open No. H3-103085 (page 1, FIG. 1).

However, in the conventional sewing machine with needle holder of needle interval adjustable type, in particular, when the fitting position of the sub needle holder is changed relatively to the main needle holder so as to expand the longitudinal width of the plural needles, the lateral width of the plural needles is also expanded, and specified sewing quality could not be obtained.

It is hence a primary object of the present invention to provide a sewing machine with needle holder of needle interval adjustable type capable of widening or narrowing the longitudinal width of plural needles without changing the lateral width.

SUMMARY OF THE INVENTION

A sewing machine with needle holder of needle interval adjustable type comprises a looper, a main needle holder, a sub needle holder, and a plurality of needles. The looper is fixed to a looper stand, and moves laterally beneath a needle plate. The main needle holder is disposed above the needle plate, and has a screw portion for fitting a needle bar. The sub needle holder is fitted to the main needle holder by a set screw so as to be adjustable in position. The plurality of needles are individually fitted to the needle holders, and penetrate through a needle hole of the needle plate when descending. In the sewing machine with needle holder of needle interval adjustable type, when loosening the set screw, the fitting position of the sub needle holder to the main needle holder is changed, and the interval of the plural needles can be widened or narrowed.

It is a feature of the present invention that a longitudinal slit is linearly formed in the main needle holder. A fitting position of the sub needle holder to the main needle holder is changed on the longitudinal slit, and cloth penetration lines by at least two needles of the plural needles are arranged in a narrow width.

According to the present invention, the fitting position of the sub needle holder to the main needle holder is changed along the longitudinal slit formed linearly on the main needle holder. Therefore, when extending the longitudinal width of the plural needles, the lateral width is indifferent, and the cloth penetration lines by at least two needles of the plural needles can be mutually set along in a narrow width.

In the present invention, preferably, the plural needles fitted to the needle holders are disposed at the sliding surface side of the longitudinal slit. Corresponding to the plural needles, a plurality of loopers may be provided, and the looper responsible for the needles of the sub needle holder is mounted on the looper stand through the looper holder so as to be adjustable in the longitudinal direction, and when changing the fitting position of the sub needle holder, the corresponding looper may be changed together. Further preferably, a guide piece may be provided at the lower side of the needle plate, and the needle hole of the needle plate may be partly blocked by the guide piece from the cloth feed direction.

In a preferred specific structure of the present invention, the longitudinal slit of the main needle holder is extended linearly forward from the main needle holder, and a concave sliding surface is provided at its left side. The longitudinal slit of the main needle holder has the sub needle holder, and this sub needle holder is slidably fitted to the concave sliding surface of the longitudinal slit. The sub needle holder is fixed by a set screw through a slot formed in the longitudinal slit. At the lower end of the main needle holder, a fitting hole for needle is opened, and the upper portion of the right needle is fixed in the right needle fitting hole. At the lower end of the sub needle holder, a fitting hole for needle is opened, and the upper portion of the left needle is fixed in the left needle fitting hole. By forming the needle fitting holes of the needle holders by deviating longitudinally, the cloth penetration lines by needles at the time of sewing are mutually set along in a narrow width. A plurality of loopers are disposed beneath the needle plate, and one looper is responsible for the right needle, and its base is mounted on the looper stand. Other looper is responsible for the left needle disposed ahead of the first looper, and its base is mounted on a looper holder. The looper holder has a sliding portion, and its sliding portion is fixed to the concave sliding surface formed in the looper stand by a screw. The looper holder is designed to slide longitudinally along the concave sliding surface of the looper stand when loosening the screw. The guide piece is fixed by a screw through a slot of the needle plate. Out of the needle holes in the needle plate, the needle hole for left needle penetration is partly blocked from the cloth feed direction by the guide piece of the needle holes of a presser foot disposed above the needle plate for pressing the cloth to the needle plate, the needle hole for left needle penetration is a slot, and after changing the position of the sub needle holder to the main needle holder, the left needle also penetrates through the slot. By recessing the top of the needle plate around the slot, the screw is prevented from projecting above the needle plate.

DETAILED DESCRIPTION OF THE PREFERRED EMBODIMENT

Figure 1:
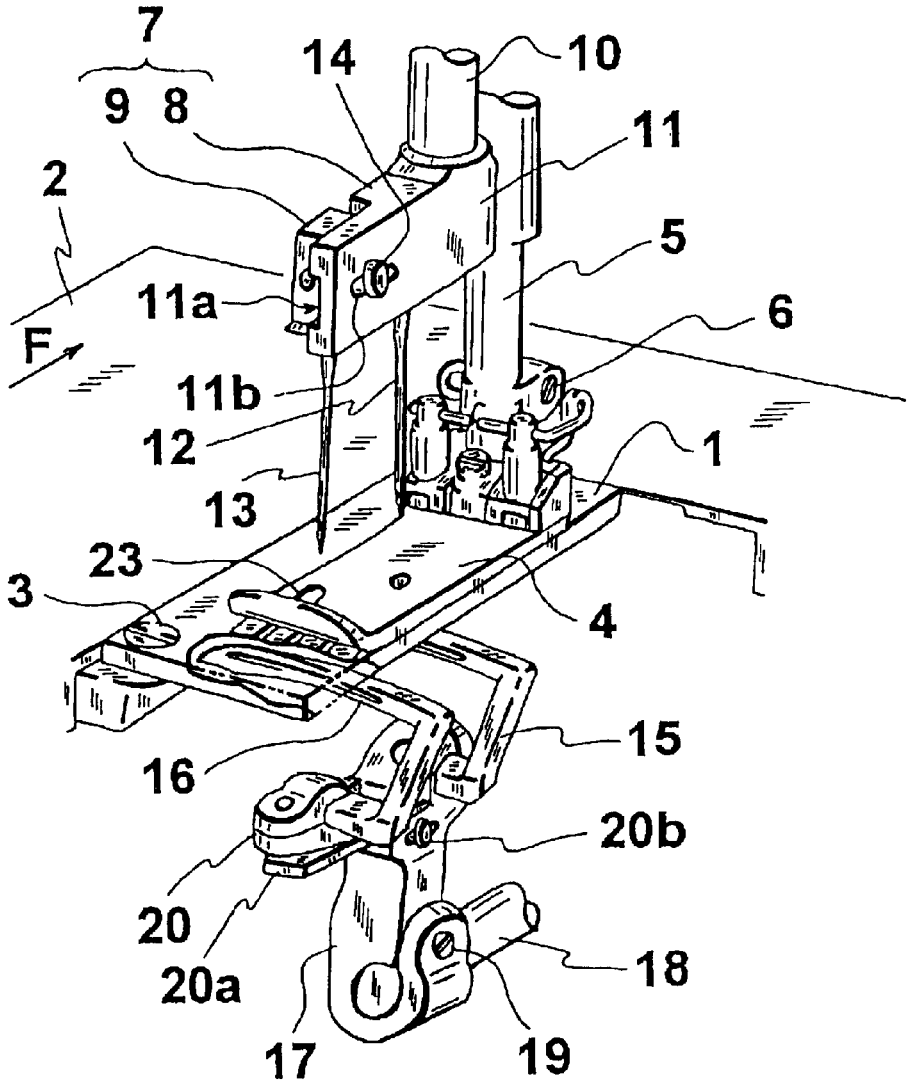
FIG. 1 is an essential perspective view showing a sewing machine with needle holder of needle interval adjustable type according to the present invention.

Referring now to the drawings, a preferred embodiment of the present invention is described below. FIG. 1 is an essential perspective view showing a sewing machine with needle holder of needle interval adjustable type according to the present invention. A needle plate 1 is fixed to a cloth platform 2 by a screw 3, and both tops are on a same plane. A presser foot 4 is disposed above the needle plate 1. The presser foot 4 is fixed to a pressure bar 5 by a screw 6, and the pressure bar 5 is pressed down by a coil spring (not shown) disposed in a sewing machine arm. That is, the presser foot 4 presses the cloth to the needle plate 1. Beneath the needle plate 1, a known feed dog (not shown) is disposed. The feed dog intermittently comes in and out from the slit of the needle plate, and cooperates with the presser foot 4 when the feed dog comes out, so that the cloth is conveyed in cloth feed direction F.

Figure 2:
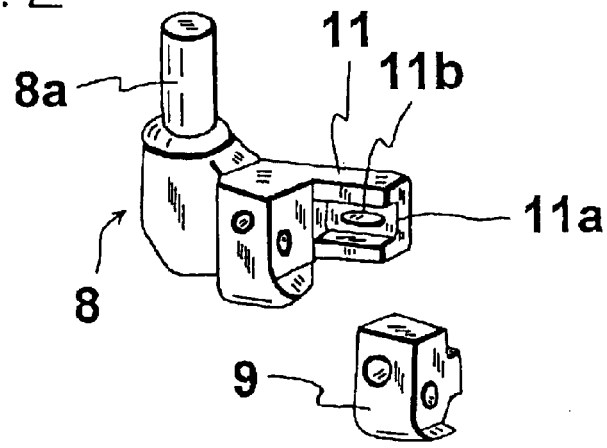
FIG. 2 is a perspective exploded view showing needle holders of the sewing machine.

Above the needle plate 1, a needle stub 7 is disposed. The needle stub 7 is composed of a main needle holder 8 and a sub needle holder 9. The main needle holder 8 has, as shown in FIG. 2, a screw portion 8*a* for mounting a needle bar, and the screw portion 8*a* fitted into the lower end of the needle bar 10. The main needle holder 8 also has a longitudinal slit 11. The longitudinal slit 11 is extended linearly forward from the main needle holder 8, and it has a concave sliding surface 11*a* at the left side. A fitting hole for needle is opened at the lower end of the main needle holder 8, and the upper part of a right needle 12 is fixed in the fitting hole for right needle.

Figure 4:
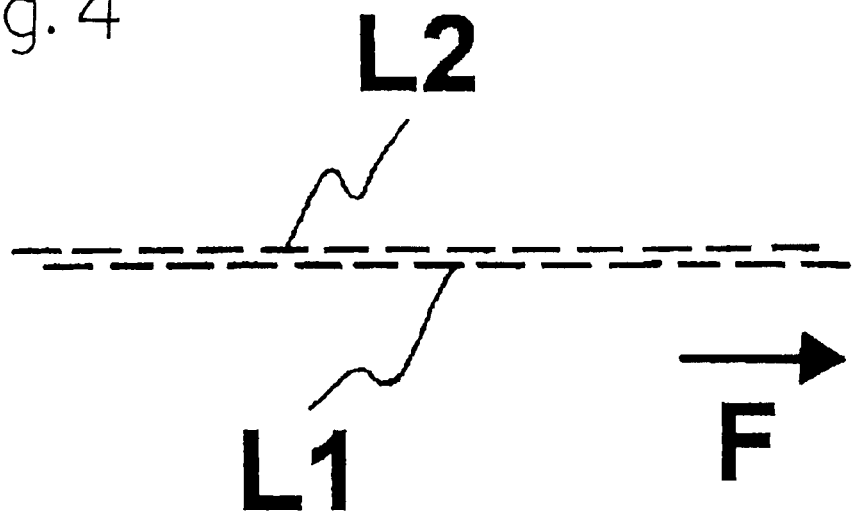
FIG. 4 is a schematic plan view showing cloth penetration lines when sewing by the sewing machine.

A sub needle holder 9 is disposed in the longitudinal slit 11 of the main needle holder 8. This sub needle holder 9 is slidably fitted to the concave sliding surface of the longitudinal slit 11, and it is fixed by a set screw 14 through a slot 11*b* formed in the longitudinal slit 11. A fitting hole for needle is opened at the lower end of the sub needle holder 9, and the upper part of a left needle 13 is fixed in the fitting hole for left needle. The plural needles 12, 13 fitted to the needle holders 8, 9 are disposed at the side of the sliding surface 11*a* of the longitudinal slit 11. The needle bar 10 is driven to slide vertically by a known needle driving device installed in a sewing machine arm, and when the needles 12, 13 descend, they penetrate through the needle holes of the presser foot 4 and needle plate 1. By forming the needle fitting holes of the needle holders 8, 9 by deviating longitudinally, as shown in FIG. 4, cloth penetration lines L1, L2 by the needles 12, 13 at sewing can be set along with each other in a narrow width.

Plural loopers 15, 16 are disposed beneath the needle plate 1. One looper 15 is responsible for the right needle 12, and its base is fitted to a looper stand 17. The looper stand 17 is fixed to an oscillating shaft 18 by a screw 19. The oscillating shaft 18 cooperates with rotation of the main shaft of the sewing machine (not shown), and oscillates in a direction intersecting with the cloth feed direction F (moves laterally). Other looper 16 is disposed ahead of the looper 15. The looper 16 is responsible for the left needle 13, and its base is fitted to a looper holder 20. The looper holder 20 has a sliding portion 20*a*, and the sliding portion 20*a* is fixed to a concave sliding surface formed in the looper stand 17 by a screw 20*b*. The looper holder 20 is slidable back and forth along the concave sliding surface of the looper stand 17 when the screw 20*b* is loosened. That is, the looper 16 responsible for the needle 13 of the sub needle holder is fitted to the looper stand 17 through the looper holder 20 so as to be adjustable in longitudinal position.

Figure 3:
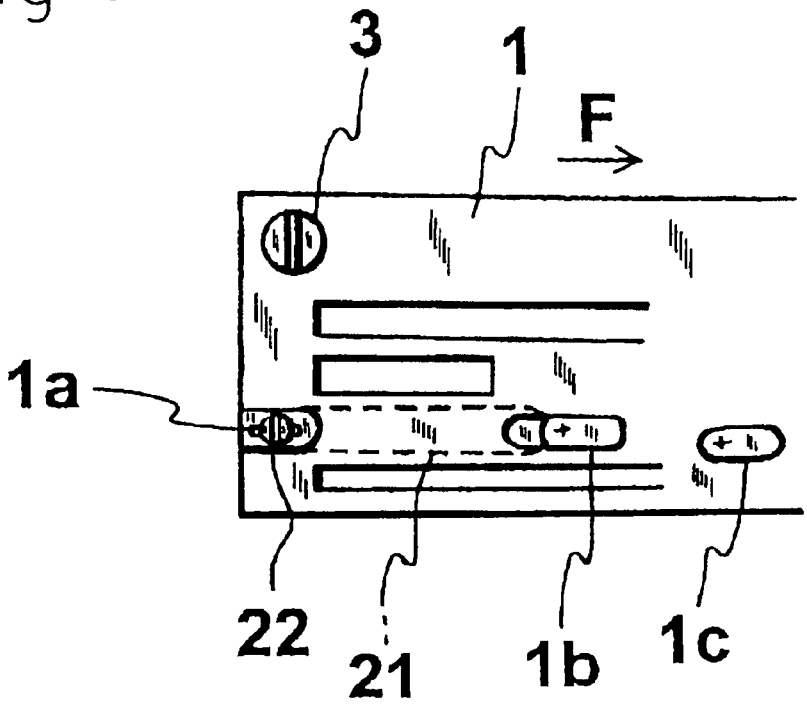
FIG. 3 is a schematic plan view showing essential parts of needle plate of the sewing machine.

At the lower side of the needle plate 1, a guide piece 21 is attached as shown in FIG. 3. The guide piece 21 is fixed by a screw 22 through a slot 1*a* of the needle plate 1. Out of the needle holes 1*b*, 1*c* of the needle plate, the needle hole 1*b* for penetration of the left needle 13 is partly blocked by guide piece 21 from the cloth feed direction F. Out of the needle holes in the presser foot, a needle hole 23 for penetration of the left needle 13 is a slot. After change of the position of the sub needle holder 9 to the main needle holder 8, the left needle 13 penetrates through the slot 23. By recessing the top of the needle plate around the slot 1*a*, the screw 22 is prevented from projecting above the needle plate 1. This is a structure for preventing interference of cloth conveyance.

What is claimed is:

1. A sewing machine with needle holder of needle interval adjustable type comprising loopers comprising mounted on a looper stand movable laterally beneath a needle plate, a main needle holder disposed above the needle plate and having a screw portion for fitting needle bar, a sub needle holder fitted to the main needle holder by a set screw so as to be adjustable in position, and plural needles individually fitted to the needle holders and penetrating through needle holes of the needle plate when descending, whereby capable of narrowing or widening the interval of the plural needles by changing the fitting position of the sub needle holder to the main needle holder when loosening the set screw, characterized in that the fitting position of the sub needle holder to the main needle holder is changed by a longitudinal slit formed linearly in the main needle holder, and cloth penetration lines by at least two needles of the plural needles are mutually arranged in a narrow width.

2. The sewing machine with needle holder of needle interval adjustable type as defined in claim 1, wherein the plural needles fitted to the needle holders are disposed at a sliding surface side of the longitudinal slit.

3. The sewing machine with needle holder of needle interval adjustable type as defined in claim 1, wherein the longitudinal slit of the main needle holder is extended linearly forward from the main needle holder, and a concave sliding surface is formed at its left side.

4. The sewing machine with needle holder of needle interval adjustable type as defined in claim 1, wherein the sub needle holder is disposed in the longitudinal slit of the main needle holder, said sub needle holder is slidably fitted to a concave sliding surface of the longitudinal slit.

5. The sewing machine with needle holder of needle interval adjustable type as defined in claim 1, wherein the sub needle holder is fixed by the set screw through a slot formed in the longitudinal slit.

6. The sewing machine with needle holder of needle interval adjustable type as defined in claim 1, wherein a right needle fitting hole is opened at the lower end of the main needle holder, the upper part of the right needle is fixed in the right needle filling hole, a left needle fitting hole is opened at the lower end of the sub needle holder, the upper part of the left needle is fixed in the left needle fitting hole.

7. The sewing machine with needle holder of needle interval adjustable type as defined in claim 6, wherein the right needle fitting hole and the left needle fitting hole deviate longitudinally.

8. The sewing machine with needle holder of needle interval adjustable type as defined claim 1, wherein the loopers are provided in a plurality corresponding to the plural needles, and the looper responsible for the needle of the sub needle holder is mounted on the looper stand through the looper holder so as to be adjustable in longitudinal position.

9. The sewing machine with needle holder of needle interval adjustable type as defined in claim 1, wherein plural loopers are disposed beneath the needle plate, one looper is responsible for the right needle, and its base is mounted on the looper stand, other looper is disposed ahead of the looper and responsible for the left needle, and its base is mounted on a looper holder, the looper holder has a sliding portion, and the sliding portion is fixed to a concave sliding surface formed in the looper stand by a screw, and the looper holder is slidable longitudinally along the concave sliding surface of the looper stand when the screw is loosened.

10. The sewing machine with needle holder of needle interval adjustable type as defined in claim 1, wherein the needle plate has a guide piece at its lower side, and the guide piece partly blocks the needle hole of the needle plate from the cloth feed direction.

11. The sewing machine with needle holder of needle interval adjustable type as defined in claim 10, wherein the guide piece is fixed by a screw through a slot of the needle plate, and the needle penetration hole for the left needle out of the needle holes in the needle plate is partly blocked by the guide piece from the cloth feed direction.

12. The sewing machine with needle holder of needle interval adjustable type as defined in claim 11, wherein a needle penetration hole for the left needle out of needle holes of a presser foot disposed above the needle plate for pressing the cloth to the needle plate is a slot, and even after change of position of the sub needle holder to the main needle holder, the left needle penetrates through the slot.

13. The sewing machine with needle holder of needle interval adjustable type as defined in claim 11, wherein the top of the needle plate around the slot is recessed, and the screw is prevented from projecting above the needle plate.

* * * * *

UNITED STATES PATENT AND TRADEMARK OFFICE

CERTIFICATE OF CORRECTION

PATENT NO. : 6,904,852 B2
DATED : June 14, 2005
INVENTOR(S) : Tatsuaki Kaneda

It is certified that error appears in the above-identified patent and that said Letters Patent is hereby corrected as shown below:

Column 4,
Line 6, delete the second occurrence of the word "comprising".

Signed and Sealed this

Third Day of January, 2006

JON W. DUDAS
*Director of the United States Patent and Trademark Office*